US009267748B2

(12) United States Patent
Thordsen

(10) Patent No.: US 9,267,748 B2
(45) Date of Patent: Feb. 23, 2016

(54) SYSTEMS AND METHODS FOR RELEASING DETACHABLE FIREARM MAGAZINES

(76) Inventor: Alan T. Thordsen, San Mateo, CA (US)

( * ) Notice: Subject to any disclaimer, the term of this patent is extended or adjusted under 35 U.S.C. 154(b) by 0 days.

(21) Appl. No.: 13/248,455

(22) Filed: Sep. 29, 2011

(65) Prior Publication Data

US 2013/0081315 A1 Apr. 4, 2013

(51) Int. Cl.

| | |
|---|---|
| ***F41A 9/61*** | (2006.01) |
| ***F41A 17/38*** | (2006.01) |
| ***F41A 35/00*** | (2006.01) |

(52) U.S. Cl.

CPC . *F41A 9/61* (2013.01); *F41A 17/38* (2013.01); *F41A 35/00* (2013.01)

(58) Field of Classification Search

USPC ..... 42/90, 106, 108, 49.01, 50, 49.1, 6, 85, 42/49.02

See application file for complete search history.

(56) References Cited

U.S. PATENT DOCUMENTS

| | | | | | |
|---|---|---|---|---|---|
| 1,044,983 | A | * | 11/1912 | Brown | 42/50 |
| 1,645,031 | A | * | 10/1927 | Von Frommer | F41A 9/67 42/50 |
| 2,575,311 | A | * | 11/1951 | Barry, Jr. et al. | 411/111 |
| 3,344,817 | A | * | 10/1967 | Connard | 148/211 |
| 3,738,218 | A | * | 6/1973 | Gutshall | 411/387.7 |
| 4,906,154 | A | * | 3/1990 | Sheppard | 411/392 |
| 5,749,692 | A | * | 5/1998 | Kish et al. | 411/453 |
| 6,173,519 | B1 | * | 1/2001 | Garrett | 42/90 |
| 8,307,578 | B1 | * | 11/2012 | Azhocar | 42/108 |
| 2012/0025020 | A1 | * | 2/2012 | Plithides et al. | 244/129.1 |

* cited by examiner

*Primary Examiner* — Reginald Tillman, Jr.
(74) *Attorney, Agent, or Firm* — Kang S. Lim

(57) ABSTRACT

The present invention provides a firearm bullet button magazine release tool assembly with a tool tip and a stabilizing base. The tool tip is configured to activate a firearm magazine release assembly thereby releasing a detachable magazine. The stabilizing base increases stability, and secures the tool tip to the magazine body. The magazine release assembly also includes a threaded rod to provide mechanical stiffness to the tool tip, and is coupled to a magazine body or a magazine attachment. The tool tip can be rounded and tapered to aid insertion into and withdrawal from the magazine release assembly of the firearm. The magazine release assembly can also include a buffer to provide flexibility for absorbing impact forces without permanent damage.

8 Claims, 14 Drawing Sheets

SYSTEMS AND METHODS FOR RELEASING DETACHABLE FIREARM MAGAZINES

BACKGROUND

The present invention relates to systems and methods for releasing detachable magazines from firearms without have to carry and use an extra tool.

Different types of firearms and firearm accessories have increased steadily over time in both functionality and flexibility, and today, there is a wide variety of firearms and accessories available. Innovation in the firearms industry is also driven by legislative trends, as firearm owners are required to respond by limiting the functionality of their firearms and/or accessories.

In recent times, Federal and/or State laws have limited features of semi-automatic firearms and/or also the capacity of firearm magazines. For example, in some jurisdictions, the use of detachable magazines with semi-automatic rifles is strictly regulated. To comply, the magazine release mechanism of these semi-automatic rifles has to be modified to work only with a tool such as the bullet tip of a rifle cartridge. One common solution for semi-automatic AR-15 variants is to install a bullet button magazine release to prevent the user from being able to release a magazine by solely using a finger.

Unfortunately, having to carry and use a separate tool, e.g., a rifle cartridge, for loading and reloading slows down the process significantly and also introduces unnecessary complexity to the process. In addition, using the bullet tip of a rifle cartridge repeatedly as a magazine release tool is likely to adversely affect the functionality and/or accuracy of the cartridge.

It is therefore apparent that an urgent need exists for user-friendly tools for releasing magazines from semi-automatic rifles, preferably without a need for carrying around extra tools. These improved magazine release tools should enable users to quickly and effectively release magazines from rifles without lugging around extra tools or risk damage to rifle cartridges.

SUMMARY

To achieve the foregoing and in accordance with the present invention, systems and methods for releasing detachable magazines from firearms without the need for an extra tool is provided. In particular, various magazines and magazine attachments are modified to enable them to be also used as magazine release tools.

In one embodiment, a firearm magazine includes a magazine body and a magazine release tool assembly having a tool tip and a stabilizing base. The tool tip is configured to activate a button release assembly of a firearm thereby causing a detachable magazine to detach from the firearm. The stabilizing base is configured to provide a footprint for increased stability, and further configured to enable the tool tip to be tightened to the magazine body.

In some embodiments, the tool tip and the stabilizing base are made from a polymer, and the magazine release tool assembly also includes a threaded rod configured to provide mechanical stiffness to the tool tip, and further configured to be coupled to a magazine body or a magazine attachment. The tool tip can be rounded and tapered to aid insertion into and withdrawal from the bullet button magazine release assembly of the firearm. The release tool assembly can also include a buffer configured to provide flexibility in a radial axis of the tool assembly thereby enabling the tool assembly to absorb impact forces without permanent damage. This buffer can be a solid buffer ring or a coil spring buffer.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which.

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

The present invention relates to systems and methods for releasing detachable magazines from firearms without the need for an extra tool. As discussed below, various magazines and magazine attachments are modified to enable them to also function as magazine release tools. To facilitate discussion, FIGS. 1A-1D and 2A-2B illustrate six exemplary variations of magazine release tool assemblies, while FIG. 3 illustrates a rifle magazine 300 with a magazine release tool assembly 100A installed, enabling magazine 300 to be used as a magazine release tool in a manner described in greater detail below.

Figure 1A:
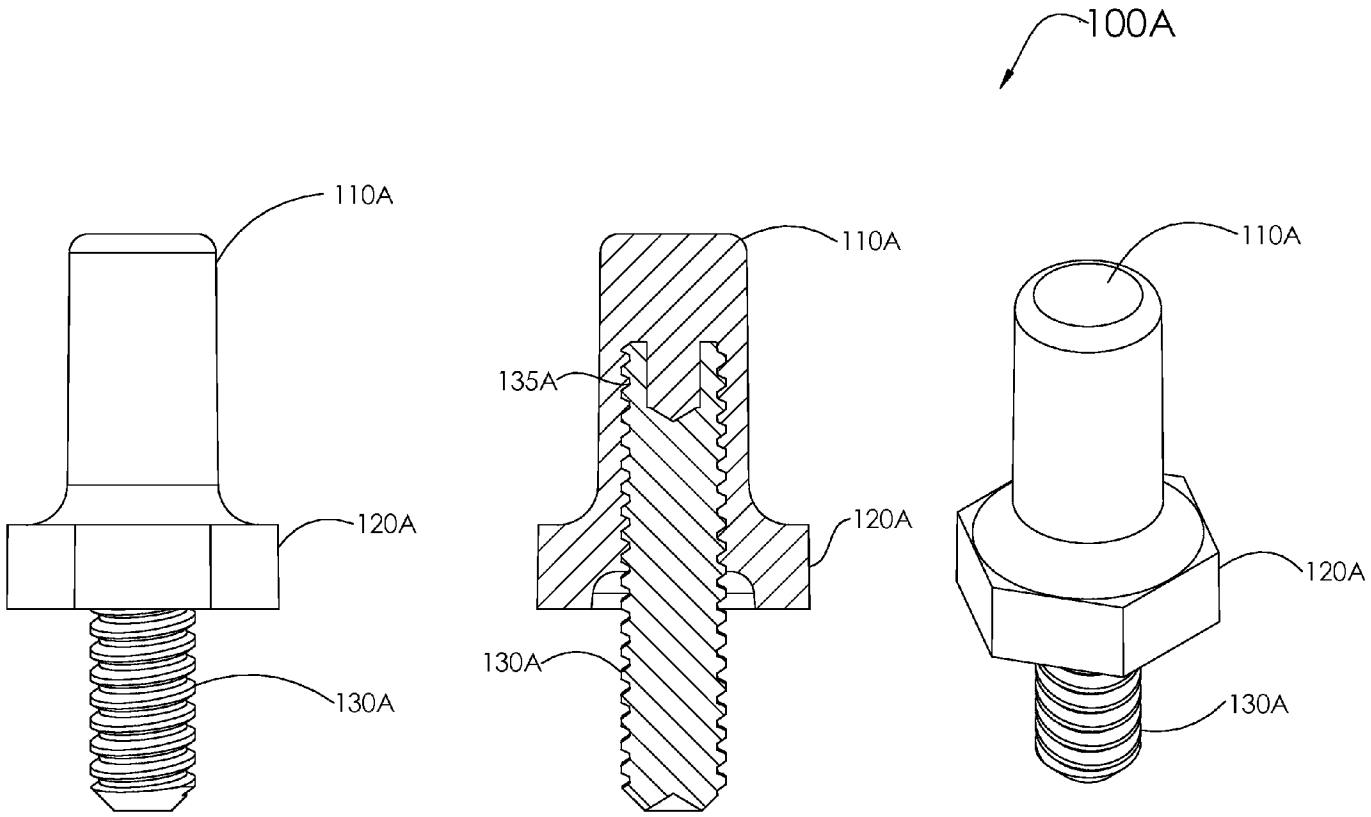
FIG. 1A includes side, cross-sectional and isometric views of a magazine release tool assembly in accordance with one embodiment of the present invention.

Referring first to FIG. 1A, a side view, a cross-sectional view, and an isometric view of one embodiment of a magazine release tool assembly 100A are shown. Assembly 100A includes a tool tip 110*a*, a stabilizing base 120*a*, and a threaded rod 130*a*.

There are several methods for constructing tool tip 110*a* of release tool assembly 100A. Tool tip 110*a* can be machined from a suitable polymer or metal. Tool tip 110*a* can also be molded from a suitable polymer and then machined, e.g., with a drill and a tap, to create a blind female threaded hole. Alternatively, tool tip 110*a* can be made from a polymer directly molded onto a threaded rod 130*a*. In this embodiment, threaded rod 130*a* is a set screw with a recessed socket head 135*a*.

Figure 3:
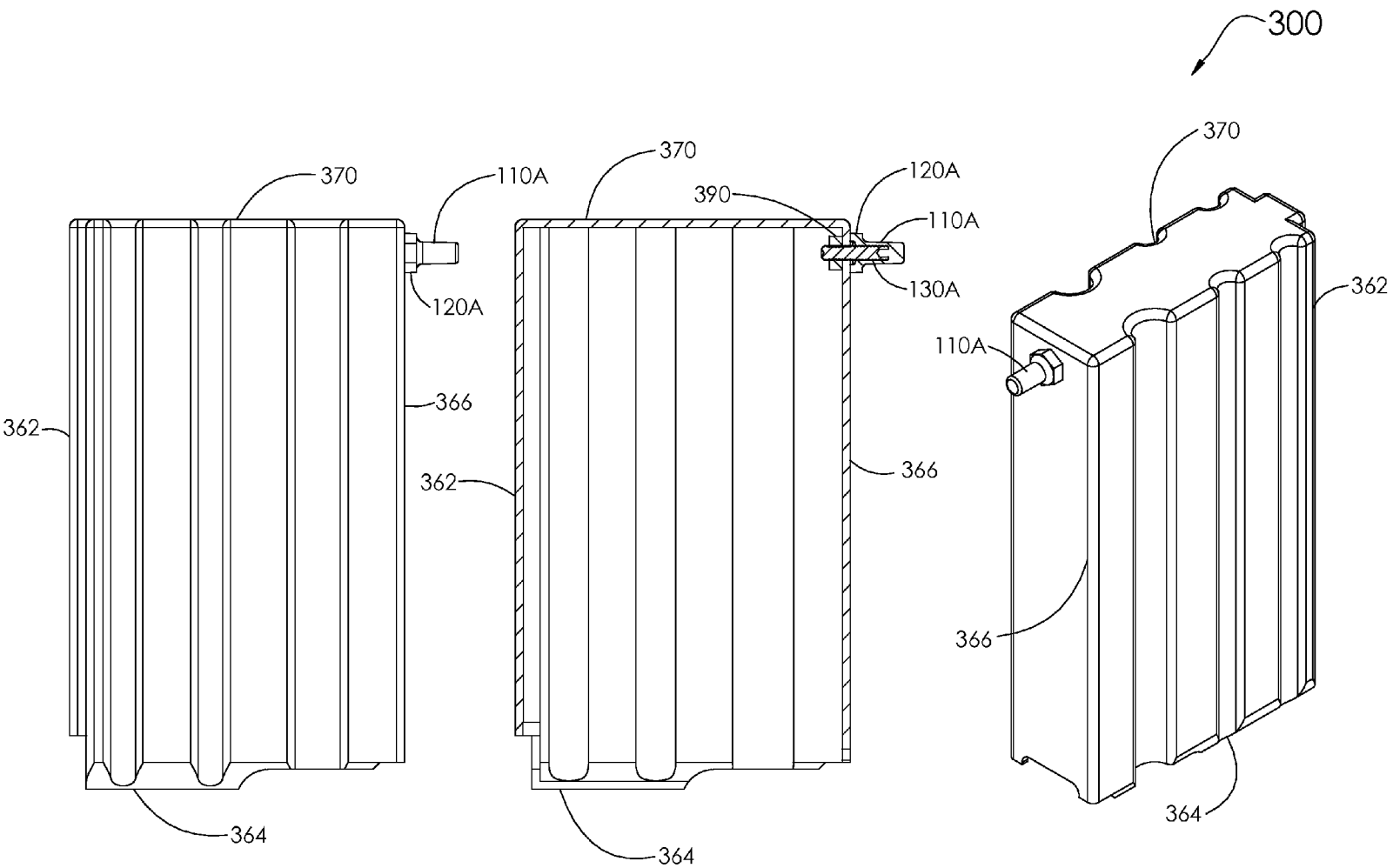
FIG. 3 illustrates a rifle magazine together with the magazine release tool assembly of FIG. 1A installed.

As shown in FIG. 3, a rifle magazine 300 has been modified to accept the magazine release tool assembly 100A of FIG. 1A. Installation includes drilling a suitably sized hole in a side wall 366 of magazine 300 located near the magazine floor plate 370. Depending on the material and thickness of side wall 366, tapping this hole in magazine wall 366 maybe an option. It may also possible to install tool assembly 100A in an existing hole on magazine 300 such as a water drainage hole. Tool assembly 100A can optionally be further secured to magazine 300 by adding a threaded nut 390.

In this embodiment, stabilizing base 120*a* has a hexagonal profile enabling tool tip 110*a* to be securely tightened to the side wall 366 and/or nut 390. The bottom of base 120*a* has a footprint that is larger than the diameter of tool tip 110*a* and hence adds stability by providing a larger contact surface area between tool assembly 100A and magazine 300.

Figure 4:
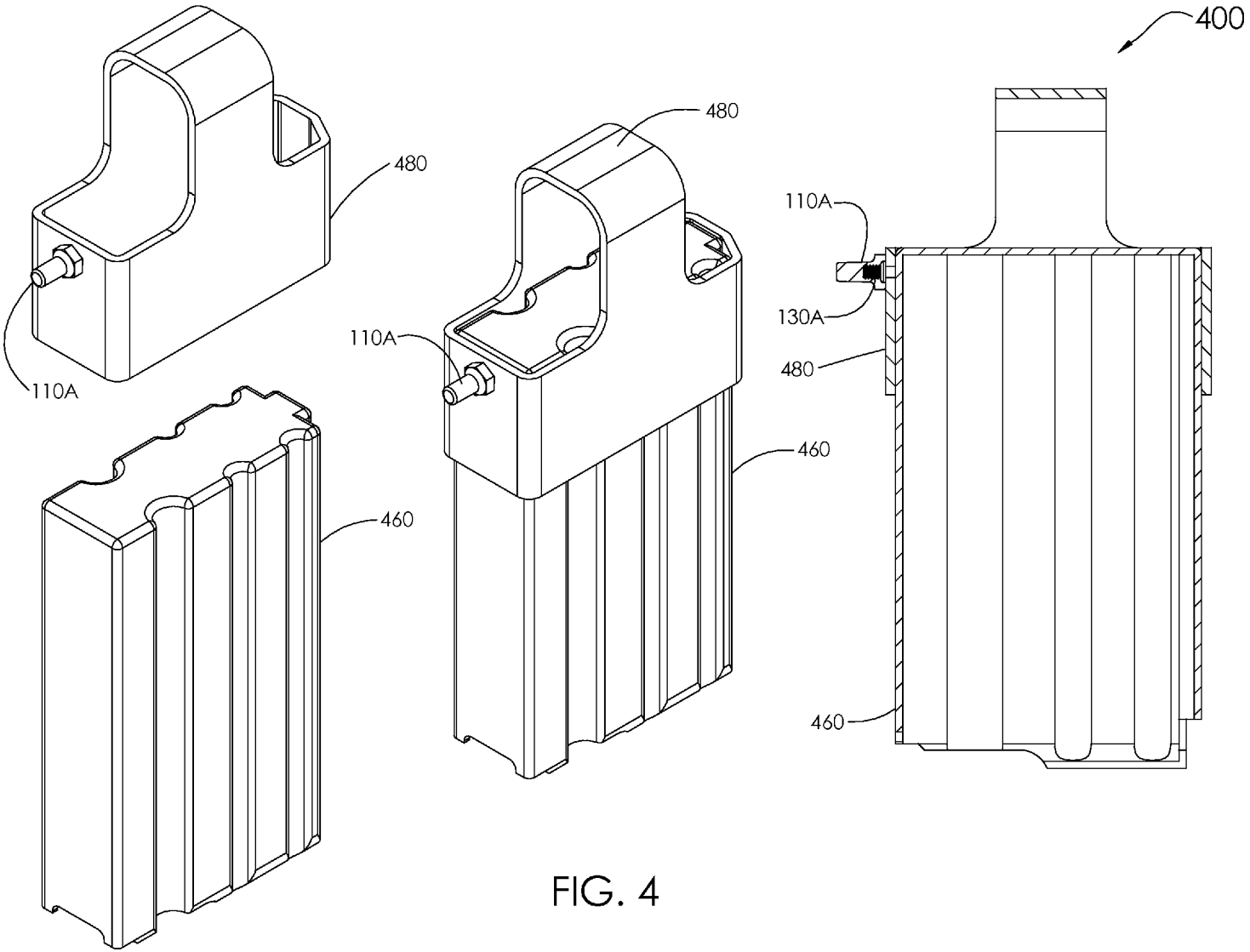
FIG. 4 illustrates a rifle magazine together with a MAGPUL™ magazine grip attachment incorporating the magazine release tool assembly of FIG. 1A.
Figure 5A:
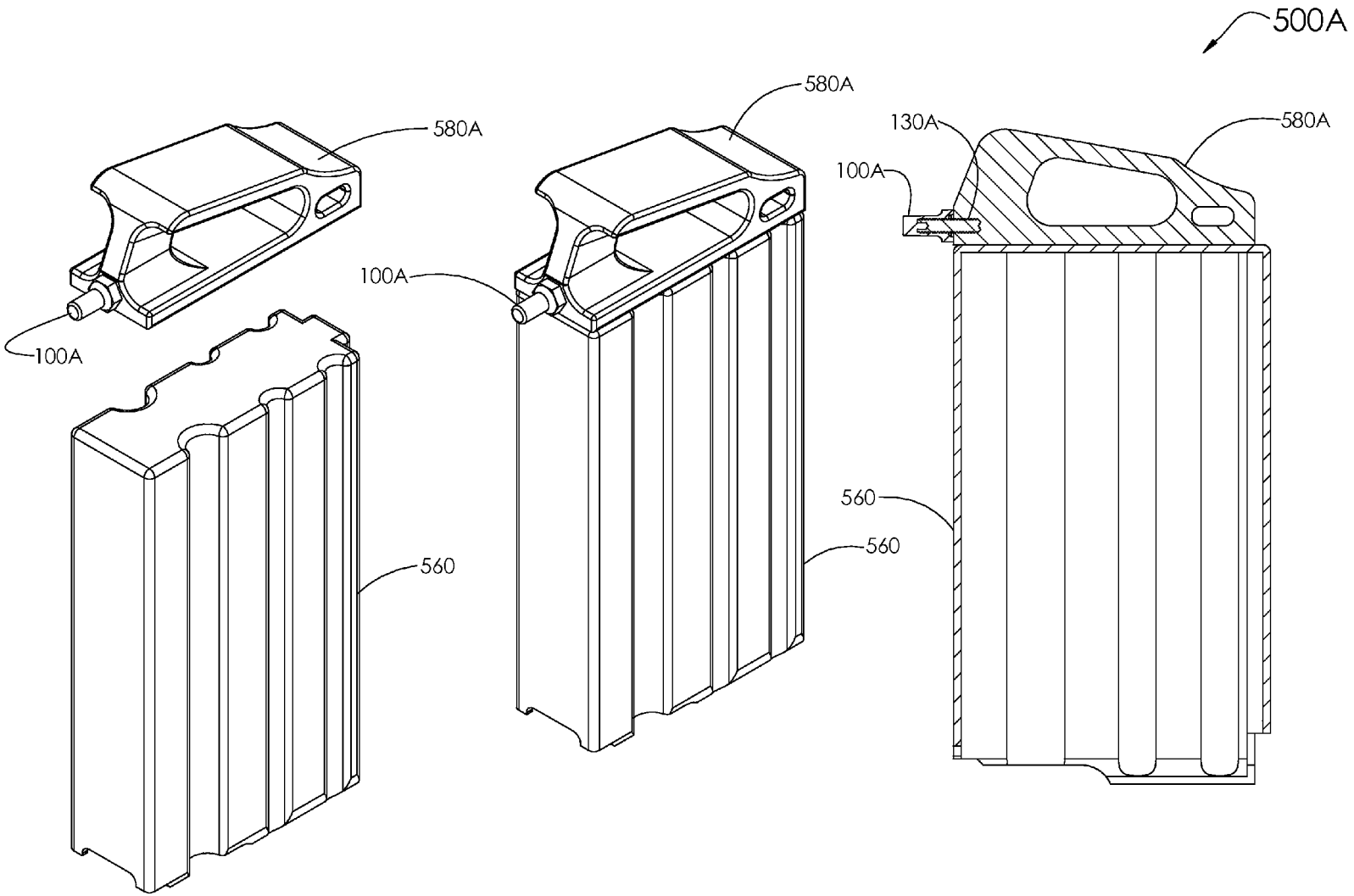
FIG. 5A illustrates a rifle magazine together with a RANGER PLATE™ magazine floor-plate attachment incorporating the magazine release tool assembly of FIG. 1A.

FIGS. 4 and 5A show two exemplary magazine accessory modifications enabling these modified accessories to also function as magazine release tools. In FIG. 4, a rifle magazine 460 is shown with a MAGPUL™ magazine grip attachment 480 incorporating the magazine release tool assembly 100A. Similarly, FIG. 5A show a rifle magazine 560 together with a RANGER PLATE™ magazine floor-plate attachment 580*a* incorporating the magazine release tool assembly 100A. Release tool assembly 100A can be retrofitted to magazine accessories such as grip attachment 480 and floor-plate attachment 580*a* using the methods described above for installing release tool assembly 100A to magazine 300.

Alternatively, it is possible to design and manufacture magazine accessories which incorporate release tool assembly 100A. For example, floor-plate attachment 580*a* can be made from a suitable polymer with a cylindrical rod or a threaded rod 130*a* permanently molded into the side of attachment 580*a* for supporting tool tip 110*a*.

Figure 5B:
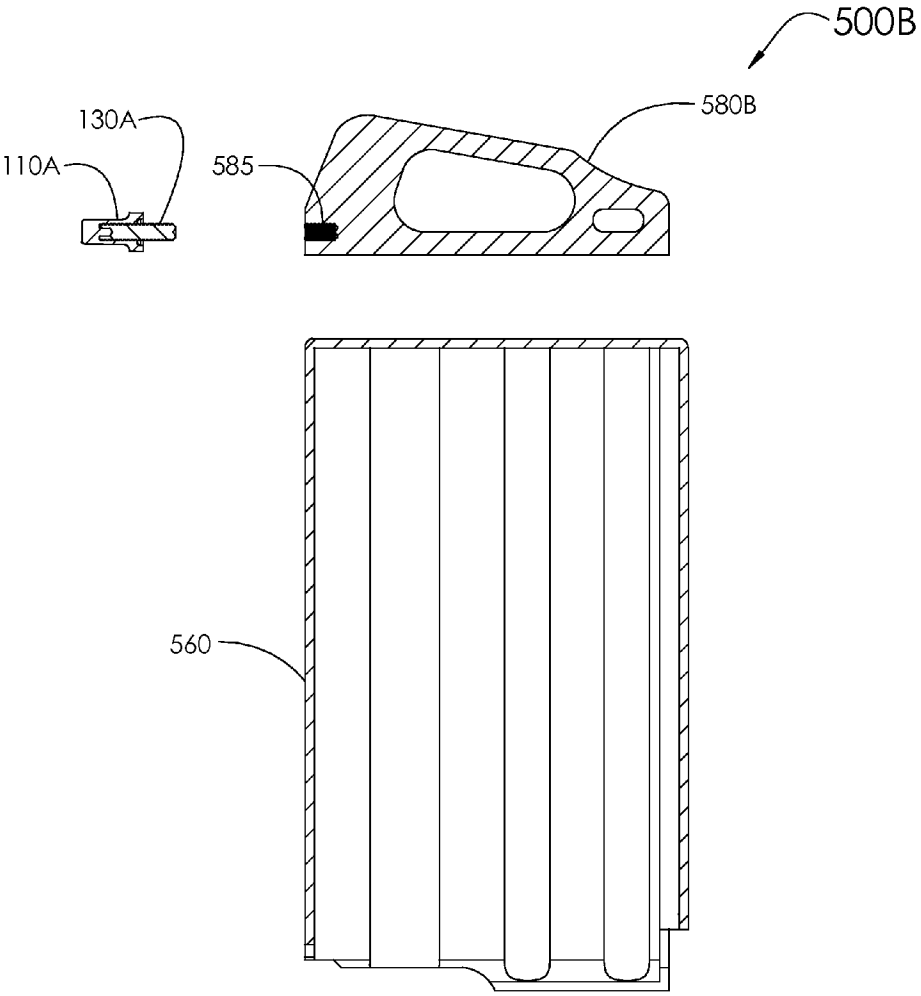
FIG. 5B is a cross-sectional close-up view of a RANGER PLATE™ with a threaded insert for attaching the magazine tool assembly of FIG. 1A.

As shown in FIG. 5B, it is also possible to mold a female threaded insert 585 into the side of floor-plate attachment 580*b*. Subsequently, the threaded rod 130*a* of release tool assembly 100A can be screwed into the threaded insert 585 of floor-plate attachment 580*b*. This arrangement allows the user to easily install an assembly 100A or replace a worn out tool tip 110*a*.

In addition, the threaded insert 585 can also be molded with a flexible buffer layer (not shown) between the insert 585 and the attachment 580*b*. Such a buffer layer provides a small amount of flexibility with respect to the radial axis of assembly 100A, thereby enabling assembly 100A to absorb some impact forces without permanent damage.

Figure 1B:
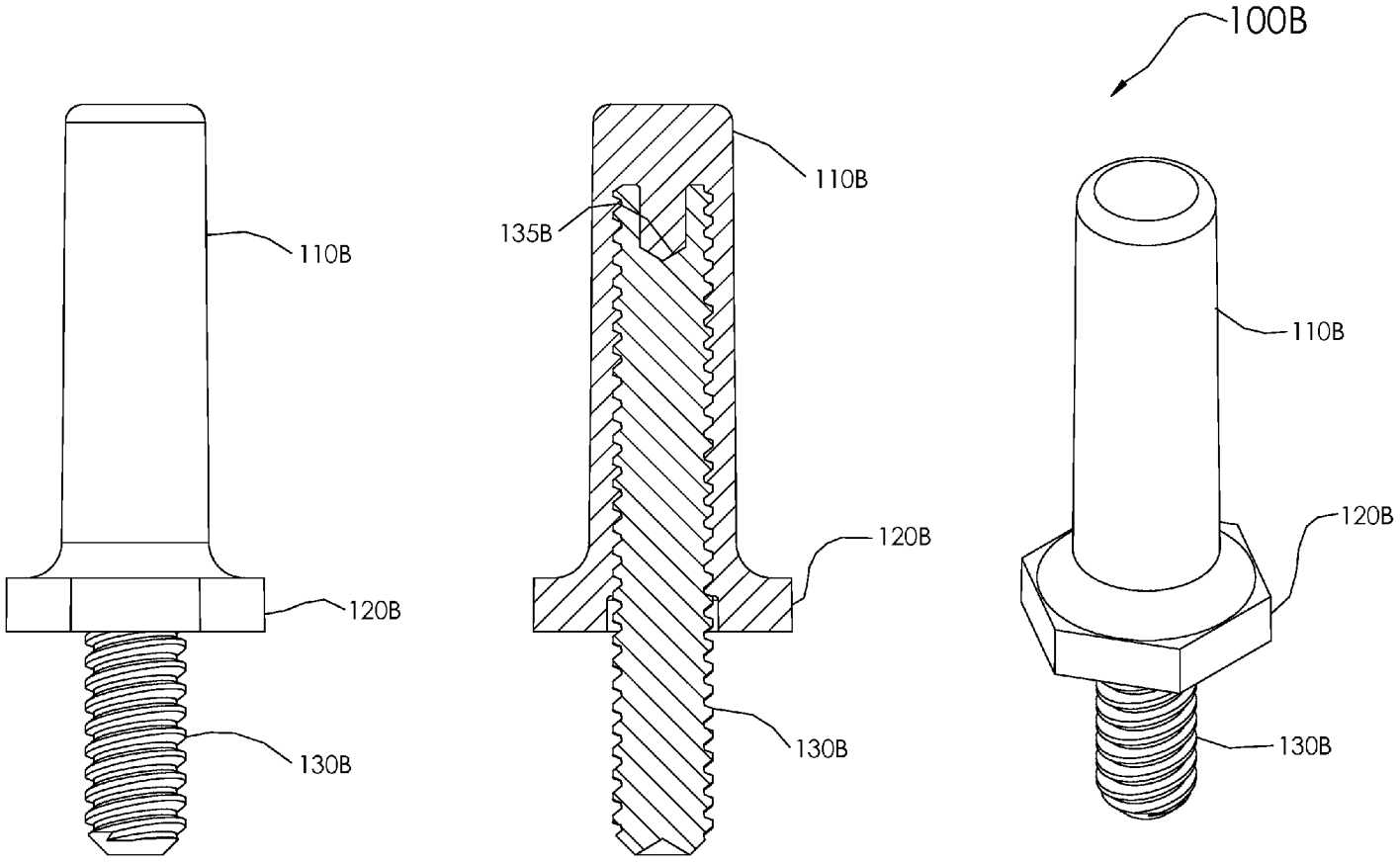
FIGS. 1B-1D are the respective views of three more variations of the magazine release tool assembly of FIG. 1A.
Figure 1C:
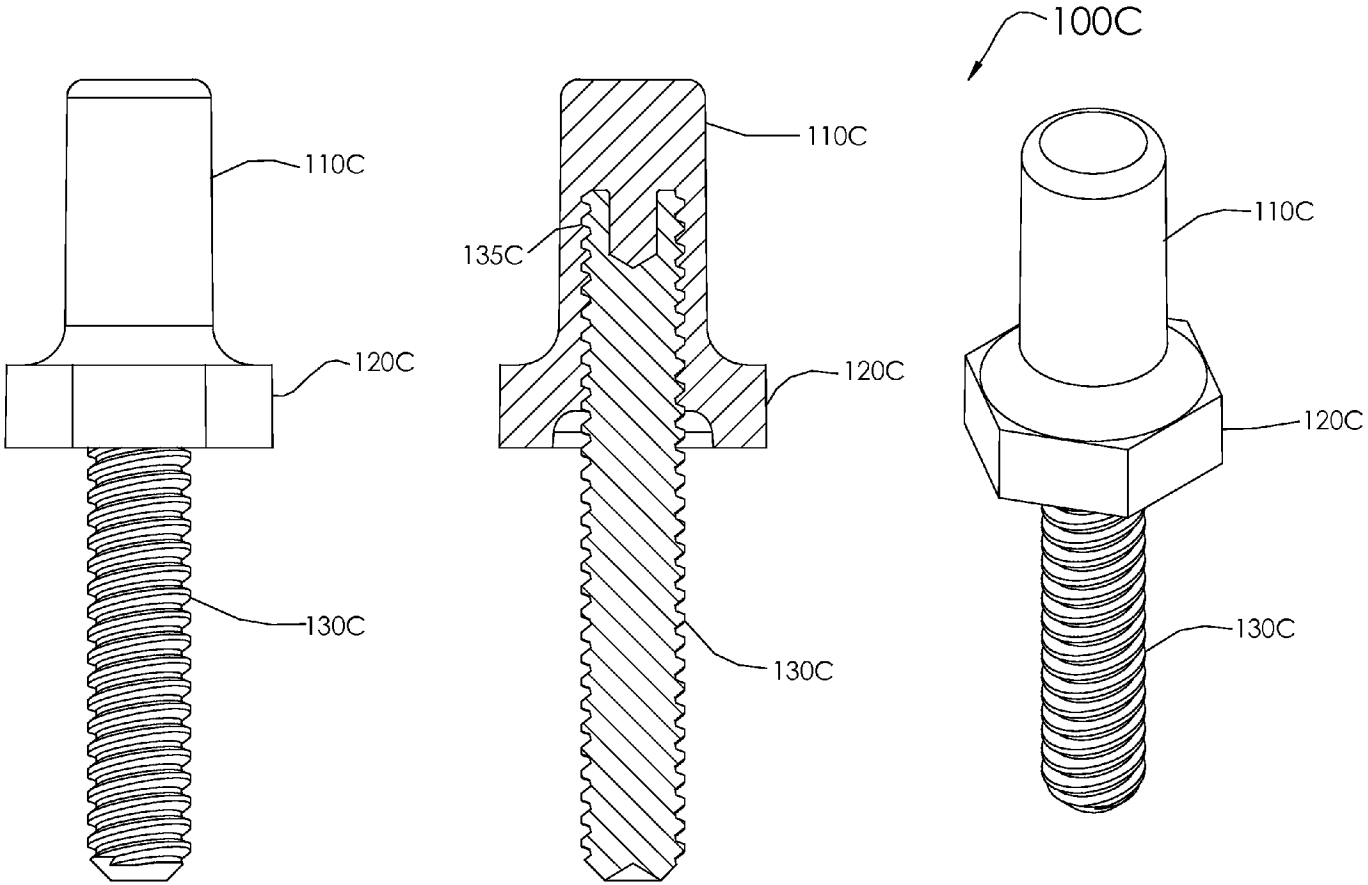
Figure 1D:
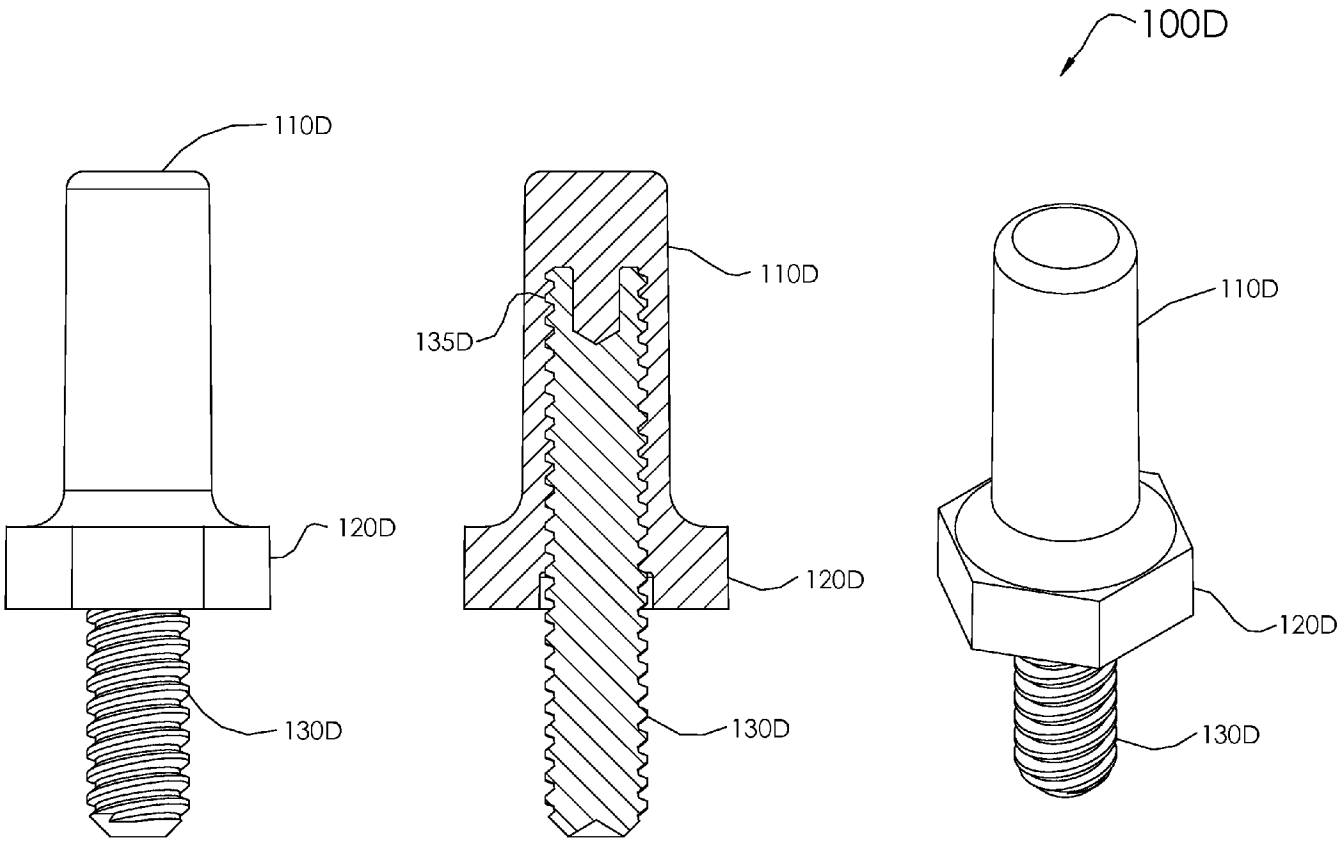

Referring back to FIGS. 1B, 1C and 1D, additional exemplary variants, such as tool tip assemblies 100B, 100C and 100D, are shown. FIG. 1B illustrates a longer tool tip 135*b*, while FIG. 1C illustrates a longer threaded rod 130*c*. Note that unlike socket head 135*a* of tool assembly 100A, FIGS. 1B, 1C and 1D show socket heads 135*b*, 135*c*, 135*d* of tool assemblies 100B, 100C, 100D inside their respective tool tips 110*b*, 110*c*, 110*d*, allowing polymer to be molded into these socket heads for a more stable and durable fit.

Figure 2A:
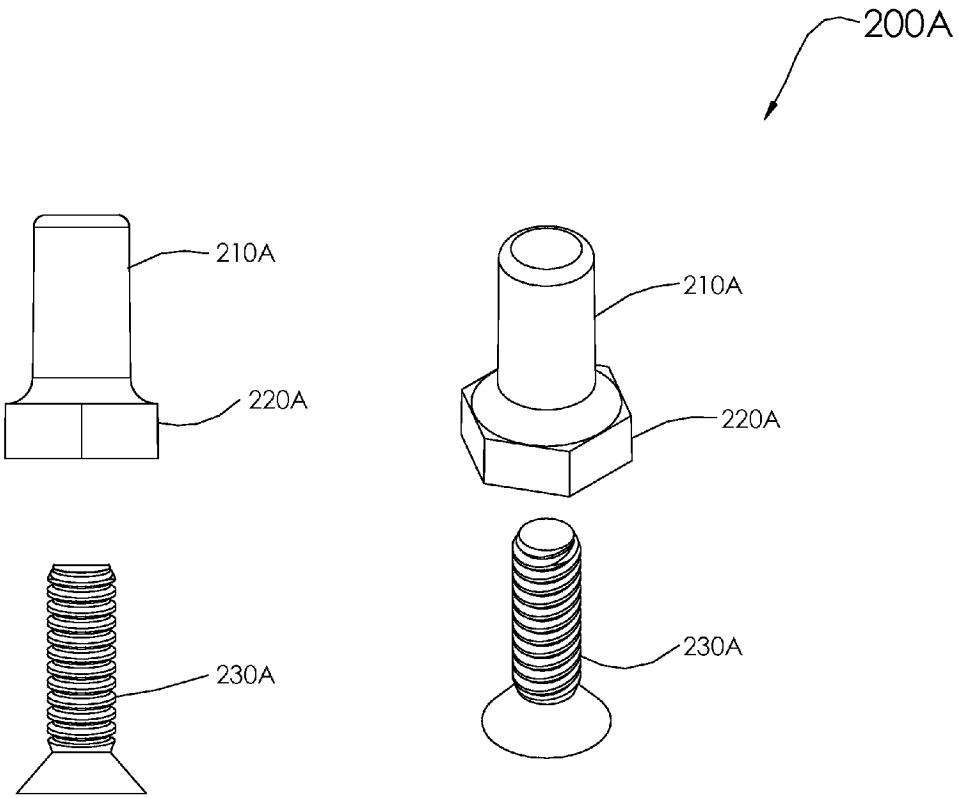
FIG. 2A shows side and isometric views of another embodiment of a magazine release tool assembly with a countersunk screw insert.

FIG. 2A shows one more embodiments of release tool assembly 200A. If the body of, for example, a polymer magazine (not shown) is thick enough, a countersunk screw 230*a* can be used in place of a set screw to secure tool tip 210*a* to the magazine. This results in a flush internal magazine body surface and hence avoids interference with the proper functioning of the internal magazine spring (not shown) during normal compression and decompression cycles.

Figure 2B:
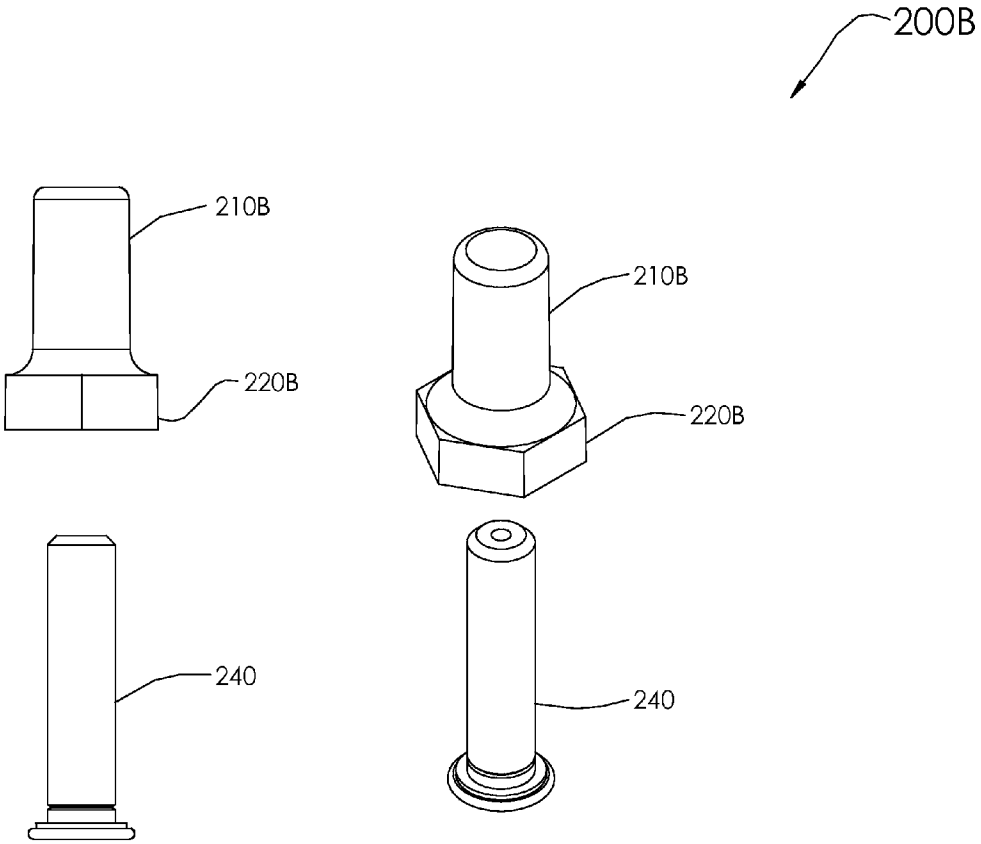
FIG. 2B shows side and isometric views of another embodiment of a magazine release tool assembly with a press-fit insert.

Alternatively, as shown in FIG. 2B, a press-fitted cylindrical rod 240 can also be used instead of a set screw. Such a configuration can also provide a flush internal magazine body surface and is well suited for metal magazine bodies. Depending on the magazine body structure and material, other configuration permutations such as press-fitted screws are also possible.

Figure 2C:
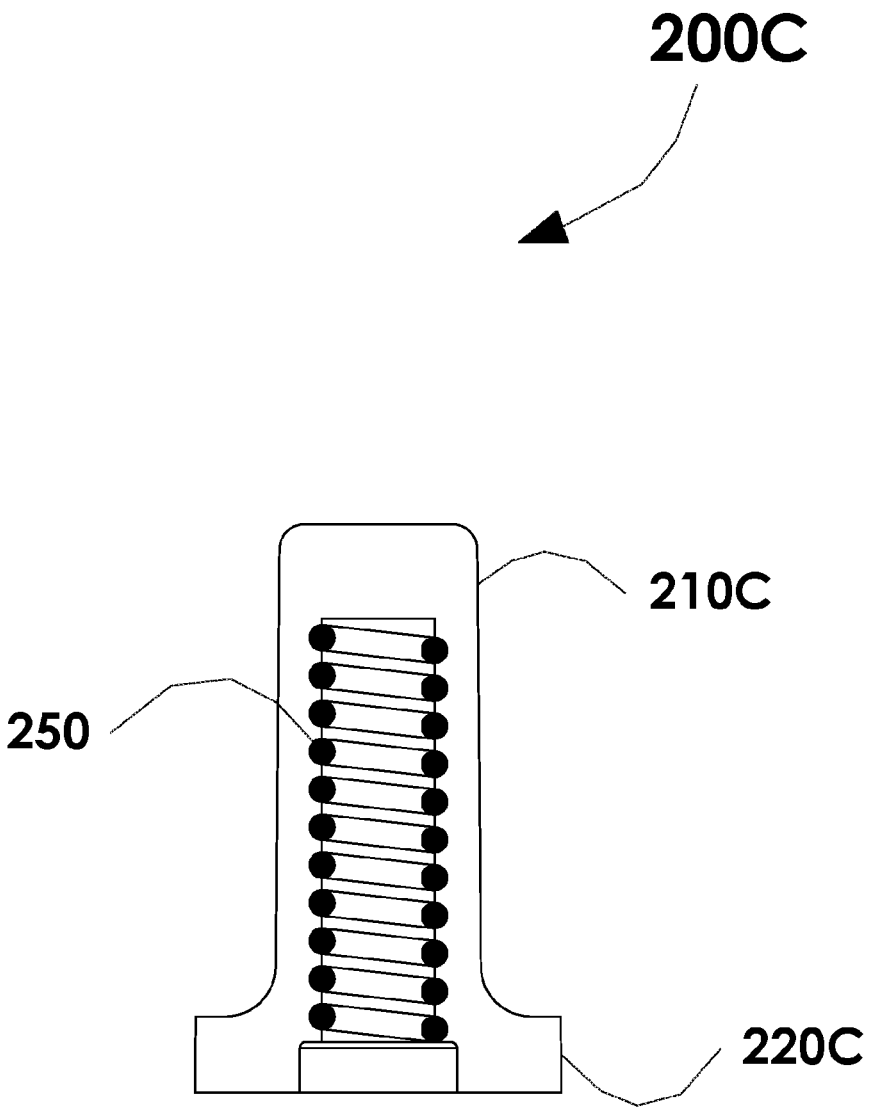
FIG. 2C is a cross-sectional view showing a polymer-encapsulated coil spring of an exemplary magazine release tool assembly in accordance with another embodiment of the present invention.

In yet another embodiment of the present invention, as illustrated by the cross-sectional view of FIG. 2C, a tool tip assembly 200C includes a tool tip 210C, a base 220C, and a coil spring 250 configured to provide mechanical stiffness to the tool tip 210C. Tool tip assembly 220C may be made from a suitable polymer material and coil spring 250 may be encapsulated in the polymer material.

Figure 6:
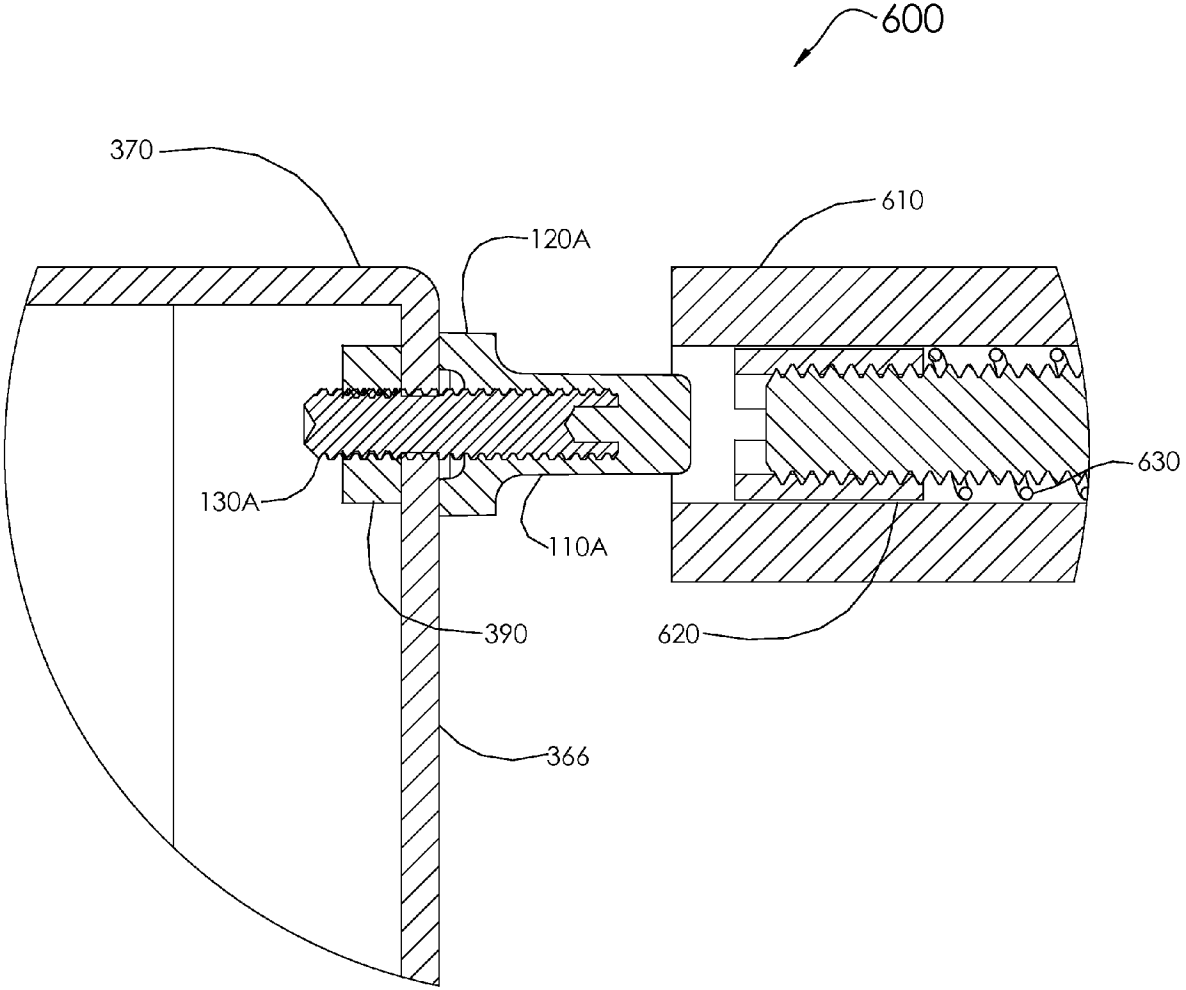
FIG. 6 is a cross-sectional view illustrating the operation of the magazine release assembly of FIG. 1A with a bullet button release mechanism of a rifle.

Referring now to FIG. 6, a magazine 300 fitted with a magazine release tool assembly including a tool tip 110*a*, a base 120*a*, a set screw 130*a* and a nut 390, is shown together with a bullet button assembly 600 having a button shield 610, a bullet button 620 and a coil spring 630. To aid the insertion of tool tip 110*a* into the opening of button shield 610, the end of tool tip 110*a* can be rounded, and the shaft of tool tip 110*a* can be tapered.

Figure 7:
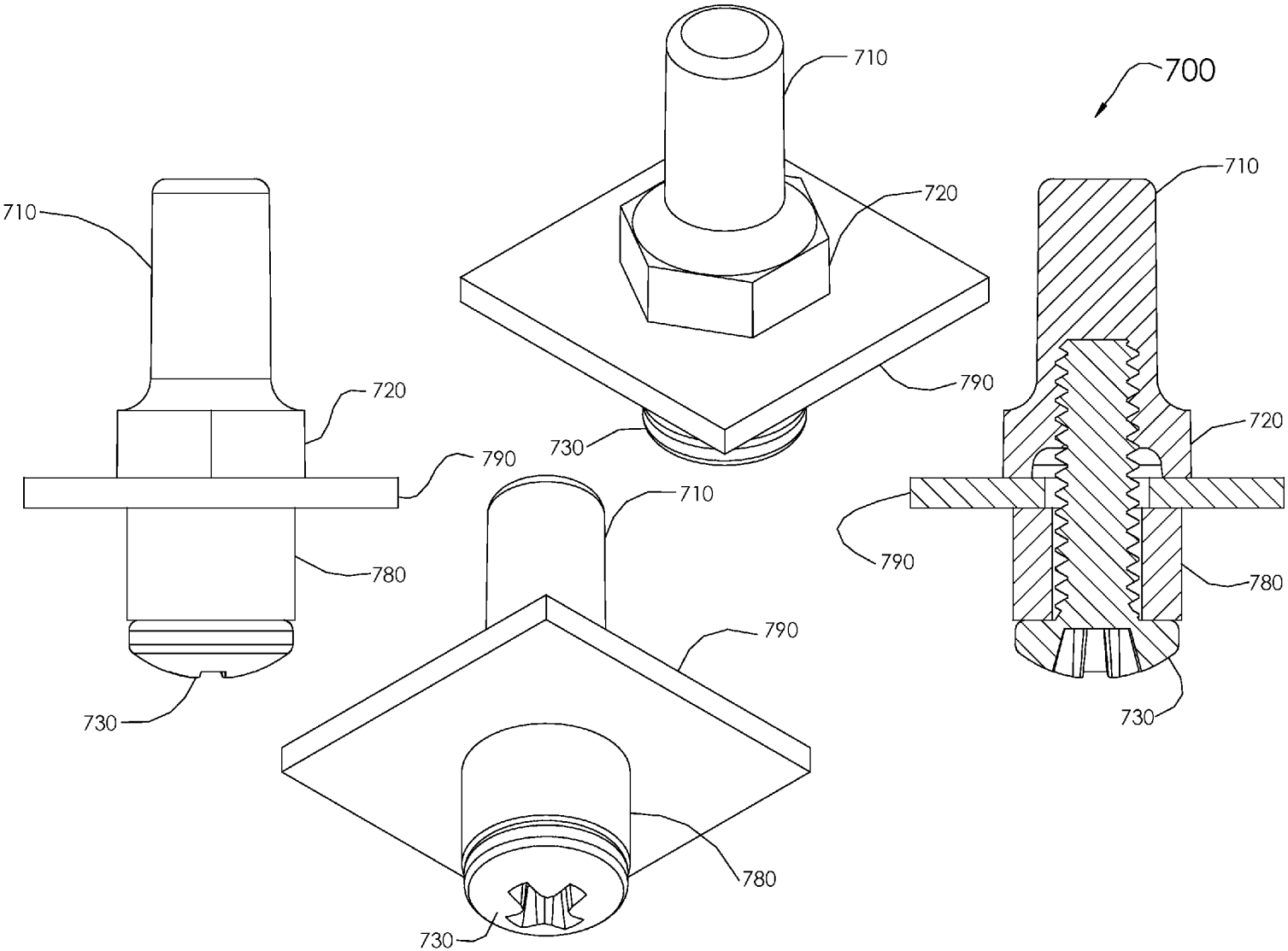
FIG. 7 shows side, cross-sectional and isometric views of another embodiment of a magazine release tool assembly with a machine screw and a solid buffer ring.
Figure 8:
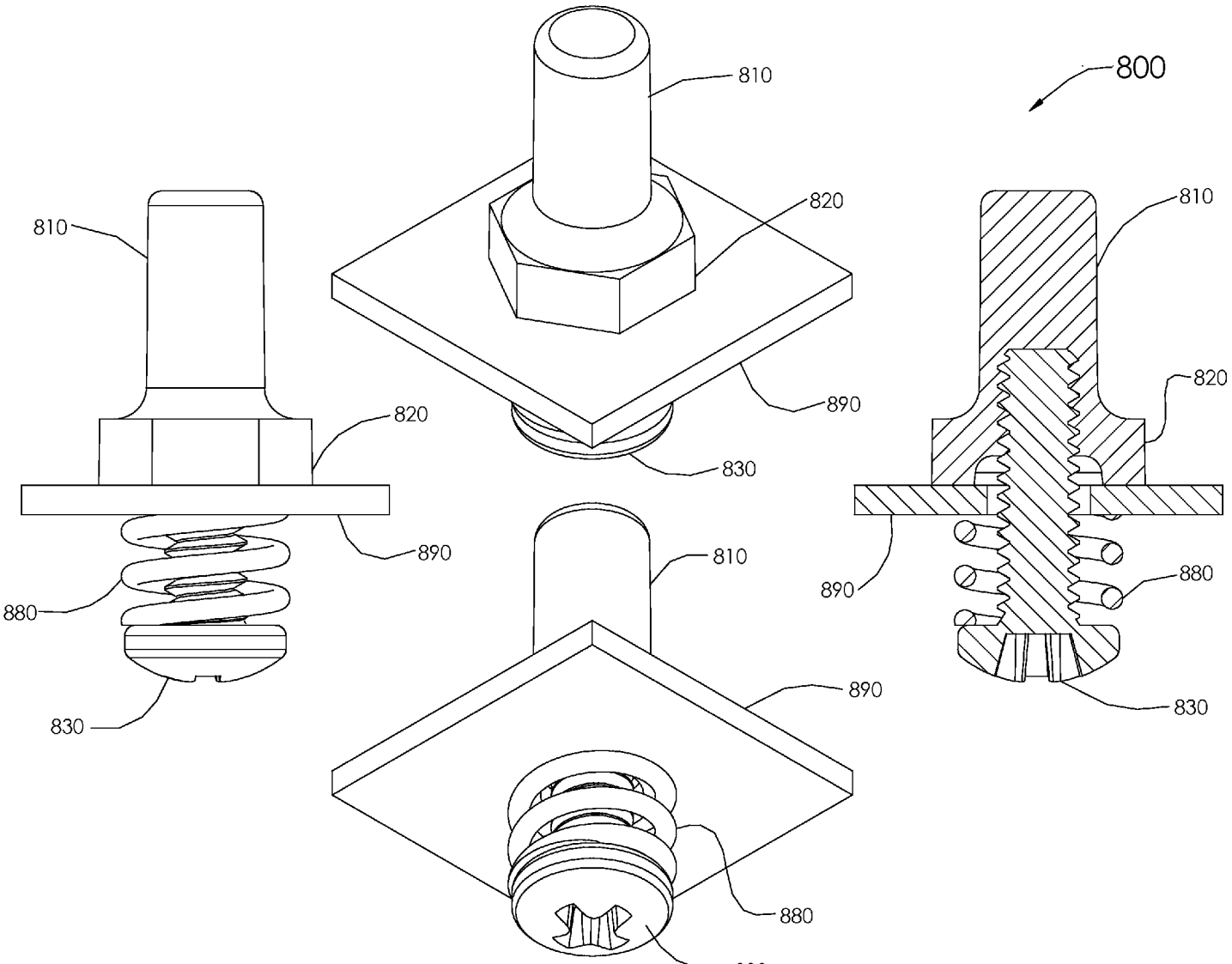
FIG. 8 shows side, cross-sectional and isometric views of another embodiment of a magazine release tool assembly with a machine screw and a coil spring buffer.

FIG. 7 includes several views of yet another variant for magazine release tool assembly 700. In this embodiment, a solid buffer 780 is added to the assembly 700 and secured by a machine screw 730. The solid buffer 780 provides a small amount of flexibility with respect to its radial axis, thereby enabling assembly 700 to absorb impact forces without permanent damage. As shown in the embodiment 800 of FIG. 8, it is also possible use a coil spring 880 (in place of the solid buffer) to provide some flexibility in the radial axis of assembly 800.

Many other materials are also suitable for constructing magazine release tool assembly 100A. For example, instead of using a suitably strong polymer such as nylon or polycarbonate discussed above, tool tip 120*a* can also be made from a metal such as steel or aluminum.

Alternatively, instead of being two separate pieces, the tool tip and threaded rod can also be integrated into a single piece of solid metal or strong polymer (not shown). It may also be possible to construct a tool tip from a polymer-encapsulated relatively-stiff coil spring having an internal spring profile that matches the pitch of a retaining machine screw (not shown).

The surface of tool tip 120*a* can also be painted, powder-coated, electroplated and/or rubberized. In addition to or in place of mechanical fastening techniques such as using screws and nuts described above, other installation techniques are also possible, including ultrasonic bonding, adhesives, chemical bonding, heat bonding and combinations thereof.

While this invention has been described in terms of several embodiments, there are alterations, modifications, permutations, and substitute equivalents, which fall within the scope of this invention. It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A firearm magazine having a magazine release tool assembly and useful in association with a firearm configured to operate with another detachable firearm magazine, the firearm magazine comprising:

a magazine body configured to store at least one firearm cartridge; and a magazine release tool assembly including:

a tool tip configured to operatively couple with a button release assembly of a firearm thereby causing another detachable firearm magazine operatively coupled to the firearm to detach from the firearm;

a stabilizing base configured to provide a footprint for increased stability;

a magazine coupler fastening the magazine tool assembly to the firearm magazine body;

wherein the tool tip and the stabilizing base are made from a polymer and wherein the magazine coupler comprises a threaded rod configured to provide mechanical stiffness to the tool tip, and further configured to be fastened to the magazine body; and a nut securing the magazine release tool assembly to the magazine body.

2. The magazine of claim 1 further comprising a buffer configured to provide flexibility in a radial axis of the tool assembly thereby enabling the tool assembly to absorb impact forces without permanent damage.

3. The magazine of claim 1 wherein the threaded rod is one of a set screw and a machine screw.

4. The magazine of claim 1 wherein the tool tip and the stabilizing base are made from a metal.

5. The magazine of claim 4 wherein the tool tip is electroplated, powder coated or rubberized.

6. The magazine of claim 1 wherein the tool tip and the stabilizing base is made from a polymer-encapsulated coil spring configured to provide mechanical stiffness to the tool tip.

7. The firearm magazine of claim 1 wherein the tool tip is tapered to aid insertion into and withdrawal from the bullet button magazine release assembly of the firearm.

8. The firearm magazine of claim 1 wherein an end of the tool tip is rounded.

* * * * *